United States Patent [19]

Roth

[11] Patent Number: 4,523,185

[45] Date of Patent: Jun. 11, 1985

[54] ZONED INTRUSION DISPLAY WITH SERIES-CONNECTED SENSORS

[76] Inventor: Albert Roth, 6248 Rockhurst Dr., San Diego, Calif. 92120

[21] Appl. No.: 358,494

[22] Filed: Mar. 15, 1982

[51] Int. Cl.[3] ..... G08B 13/08; G08B 13/02

[52] U.S. Cl. ..... 340/524; 340/530; 340/541; 340/691

[58] Field of Search ..... 340/524, 541, 547, 691, 340/525, 545, 550, 530

[56] References Cited

U.S. PATENT DOCUMENTS

| | | | |
|---|---|---|---|
| 3,634,846 | 1/1972 | Fogiel | 340/545 |
| 3,771,154 | 11/1973 | Takei | 340/547 |
| 3,940,739 | 2/1976 | Quimet | 340/525 |

*Primary Examiner*—Glen R. Swann, III

*Attorney, Agent, or Firm*—R. F. Beers; E. F. Johnston; H. Fendelman

[57] ABSTRACT

A visual display system detects and continuously displays the location of a breach in a protected building or secure area. Each of a plurality of exclusive OR gates is connected to a separate reed-type sensor switch. Each exclusive OR gate output is connected to a flip-flop network, each of which in turn is connected to a light emitting diode. Activation of a sensor switch results in lighting only of the light emitting diode associated with the area breached. A mechanism is also provided for preventing the generation of false alarms by transients or inadvertent momentary opening of any of the sensor switches.

34 Claims, 3 Drawing Figures

ZONED INTRUSION DISPLAY WITH SERIES-CONNECTED SENSORS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the field of alarm systems for detecting intrusion into one or more locations and more specifically to the field of intrusion detection systems including mechanisms for displaying the particular location where an intrusion has occurred.

Many intrusion alarm systems employ a string of series-connected normally closed, single-pole-single-throw switches as intrusion sensors. A switch is placed at each protected port of entry such as a door, window or gate. A voltage is applied across this network so that a small current flows through the loop. If any switch is opened, either momentarily or continuously, such as by opening a door or window, the interrupted current is instantly detected by the system and an audible alarm is initiated. In a typical application, the leads from each switch or group of switches are brought to a common junction box or terminal strip and connected in series so that each switch is electrically accessible from a common point. Systems have been proposed, such as that described in U.S. Pat. No. 4,118,700, for indicating which of the sensor switches of the alarm system have operated, thus indicating an intrusion in the area protected by that particular sensor switch. A basic problem with such prior art alarm display systems is that they require the use of a resistor placed in parallel with each of the sensor switches in the series chain of sensor switches, the values of each of the resistors being a predetermined multiple of the previous resistor in the chain. Due to this requirement, it can easily be envisioned that in an embodiment requiring a large number of sensor switches, the parallel resistors at the lower end of the series chain may have such a large value as to render the concept impractical. Further, such systems require the use of analog-to-digital converters which are relatively expensive and add greatly to the cost of the overall system.

SUMMARY OF THE INVENTION

In accordance with the present invention a network is described for detecting and continuously displaying the location of one or more open switches in a string of normally closed series-connected switches, and is particularly adapted to intrusion detection and alarm systems, either residential, industrial, or military. In accordance with the present invention, identical sensors in the display are jumpered across each switch or a group of switches such that if any switch opens, its respective indicator lamp in the display will be illuminated and remain on until manually reset. This is essentially accomplished by connecting a logic gate across each sensor switch or a group of sensor switches in a particular zone of the system being monitored. The output of the logic gate is connected to a flip-flop network which provides an output signal to an indicator light such as an LED on tripping of its respective sensor switch. Each combination of logic gate, flip-flop and light indicator is identical such that an unlimited number of zones may be monitored without the display system becoming unduly cumbersome and impractical. Further, no analog-to-digital converter is required. An advantage of the present invention is that it will immediately pin point the attempted zone of entry, allowing the owner or guard to take appropriate action and placing the intruder at a distinct disadvantage. Another advantage of the device of the present invention is that if the alarm system is enabled and any lamp remains illuminated after the reset button is depressed, the owner or guard knows that the indicated port is not secure and can then correct the problem immediately without searching for the cause.

Often an intrusion alarm will malfunction causing a false alarm for no apparent reason. This may be caused by a momentary opening of one of the sensor switches due to a faulty installation, defective switch or shock. Likewise, it may be caused by electrical noise or a voltage transient on the power supply line or as electromagnetically induced noise in the sensor loop. The intrusion display of the present invention will differentiate between the various causes of false alarms, since a sensor switch must be physically opened in order to turn on its respective lamp. Thus, if the false alarm is caused by a voltage transient on either the power line or on the sensor loop, none of the indicator lamps will be turned on, thereby eliminating the switches themselves as a source of the problem. This, of course, is a tremendous advantage in tracking down the source of the problem.

OBJECTS OF THE INVENTION

Accordingly, it is the primary object of the present invention to disclose an intrusion display system for indicating which zone out of a plurality of zones has been intruded upon.

It is a concominant object of the present invention to disclose an intrusion display system in which the number of sensor switches that may be utilized is virtually unlimited.

It is another object of the present invention to disclose an intrusion display and alarm system which includes a network for eliminating false alarms.

It is another object of the present invention to disclose an intrusion alarm and display system which can indicate which zone of the system has been intruded upon and which does not require the use of an analog-to-digital converter.

It is a still further object of the present invention to disclose an intrusion alarm and display system in which the alarm system cannot be reset so long as a sensor switch remains tripped.

It is a still further object of the present invention to disclose an intrusion alarm and display system for distinguishing between system voltage transients and tripped system sensor switches.

These and other objects of the invention will become more readily apparent from the ensuing specification when taken together with the drawings.

DESCRIPTION OF THE PREFERRED EMBODIMENT

Figure 1:
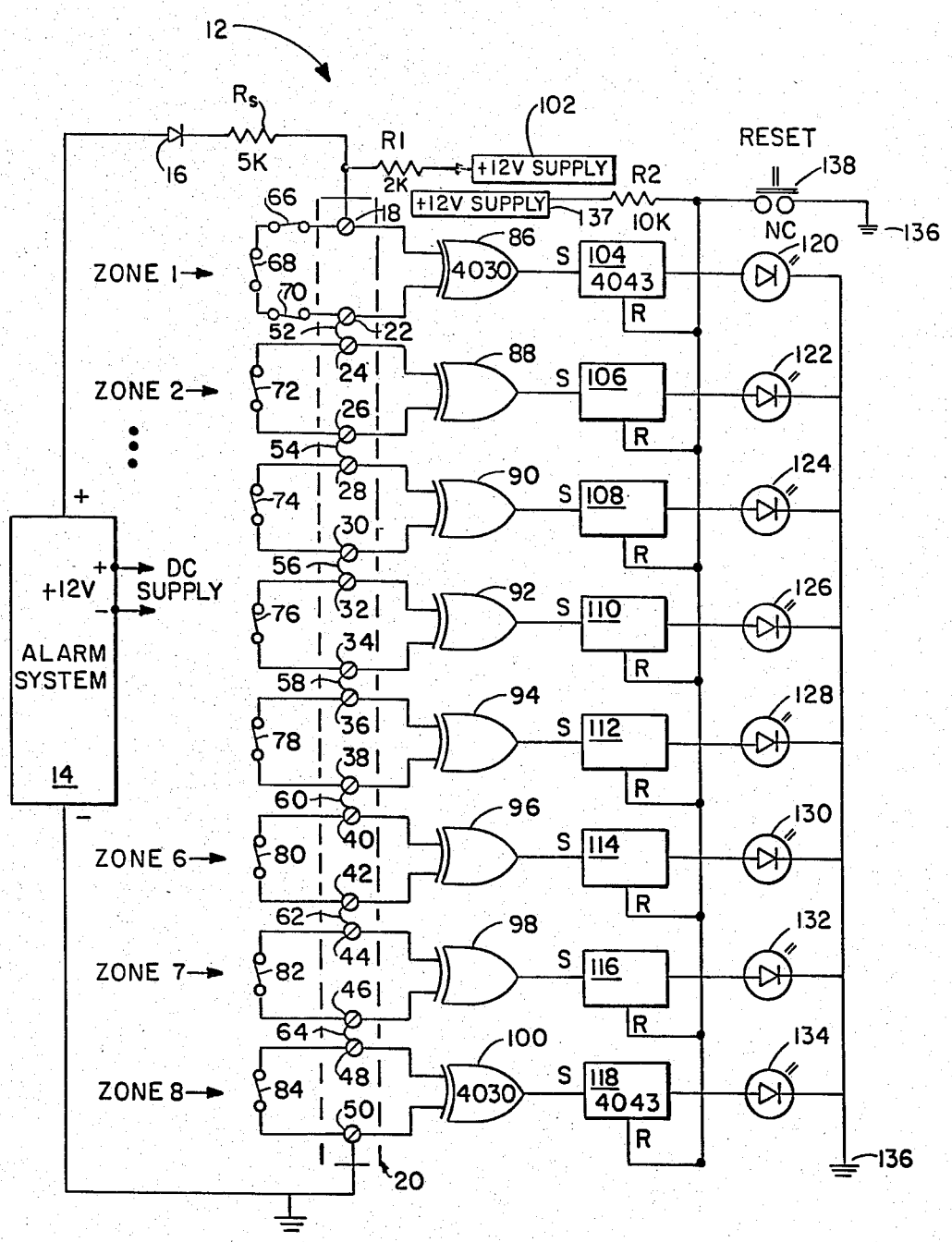
FIG. 1 is a schematic block diagram of a first embodiment of the present invention.

Referring now to FIG. 1 a first embodiment of the present invention is illustrated and will be described. The alarm system and intrusion display 12 of the present invention includes an alarm system 14. The alarm system 14 is a conventional type alarm system which includes a current generator for generating a flow of current when the system has been energized and also includes an electronic network for detecting when that flow of current has been interrupted. Upon detection of the interruption of that flow of current the alarm system 14, as is well known, sounds an audible alarm such as a bell or siren. The alarm system 14 typically is provided with a 12 volt DC supply as is illustrated.

The positive terminal of the alarm system 14 is connected to the anode of diode 16, the cathode of which is connected through resistor $R_s$ which in turn is connected to terminal 18 of the terminal strip 20. Terminal strip 20 is illustrated in the embodiment of FIG. 1 as including eight pairs of terminal contacts including contacts 18, 22, 24, 26, 28, 30, 32, 34, 36, 38, 40, 42, 44, 46, 48 and 50. It is noted that although the present embodiment is illustrated as including eight pairs of terminal contacts, any number of terminal contacts may be utilized depending upon the system requirements. Alternate pairs of the terminal contacts are connected together by strap conductors 52, 54, 56, 58, 60, 62 and 64 as illustrated.

Figure 3:
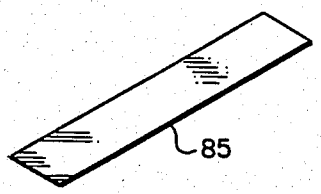
FIG. 3 is an isometric view of a portion of a strip of metallic conductive tape.

The intrusion display and alarm system of the present invention is designed to monitor intrusion into any one of a plurality of zones within the system. The zones may be the individual rooms of a house, different areas of an industrial facility or military base or the like. Each zone is provided with at least one sensor switch to detect when intrusion into that zone has occurred. In the embodiment illustrated in FIG. 1 the alarm system and intrusion display is designed to monitor eight different zones illustrated as zones 1 through 8 (inclusive). In this regard, zone 1, for instance, is provided with three sensor switches 66, 68, and 70 connected in series as illustrated and likewise connected to the terminal contacts 18 and 22. It is to be understood that, although three sensor switches are illustrated with respect to zone 1 any other number of sensor switches may be utilized within that zone ranging from one to any desired number. Likewise, each of the remaining zones 2 through 8 is equipped with a corresponding sensor switch 72, 74, 76, 78, 80, 82 and 84. By way of example only, zones 2 through 8 have been illustrated as containing only one sensor switch. The sensor switches 68, 72, 74, 76, 78, 80, 82 and 84 are preferably normally closed, single pole, single throw, reed-type sensor switches which are held closed by the generation of a magnetic field within the vicinity of the sensor switch as is well known. Other types of sensors, however, may be utilized within the scope of the present invention, such as, for example, a loop of metallic tape cemented to a window such that if the window is broken, the tape will break, opening the loop and tripping the alarm. A portion 85 of a strip of such conductive tape is depicted in FIG. 3. Each of these sensors is connected across its corresponding pair of terminal contacts. For instance, sensor switch 72 is connected across the pair of terminal contacts 24 and 26 and sensor switch 84, is connected across the pair of terminal contacts 48 and 50. The terminal contact 50 is connected to the grounded negative pole of the alarm system 14 as illustrated such that a series circuit is created from the positive terminal of the alarm system 14 through the diode 16, resistor $R_s$, through each one of the sensor switches and terminal contacts and finally back to the negative terminal of the alarm system 14.

Each zone of the alarm and intrusion display 12 of the present invention has associated with it a logic gate which, in the preferred embodiment of the present invention, is embodied as an exclusive OR gate. These exclusive OR gates 86, 88, 90, 92, 94, 96, 98 and 100 are two-input devices, each having their two inputs connected to the corresponding pair of terminal contacts previously described. The exclusive OR gates, which may be embodied as model CD4030 CMOS devices, commercially available, each operate such that only if both inputs are at different logic levels, i.e. one high and one low, will the output go high. If both input levels of the exclusive OR gates are at the same level, i.e. either both high or both low, then the output of the exclusive OR gate will be low. A power supply such as a 12 volt power supply 102, which may be the alarm system 14 DC power supply, is connected through resistor R1 to the terminal contact 18. It can thus be seen that with all the sensor switches in the closed or set position, each of the inputs to each of the exclusive OR gates will be at a logic low level.

The outputs of each of the exclusive OR gates 86, 88, 90, 92, 94, 96, 98 and 100 is connected to the corresponding set input of a latch network which, in the preferred embodiment of the present invention, is comprised of a set-reset, set dominant latch network. These set dominant latch networks 104, 106, 108, 110, 112, 114, 116 and 118 may be implemented as commercially available model number CD4043 CMOS R/S latches. Each of the latch networks also includes a reset terminal identified as terminal R in FIG. 1. The latch networks operates such that if the set input goes high when the reset input is low, the output will go high, and remain high, even if the S input subsequently goes low. If the reset input goes high while the set input is low, the output goes low or stays low depending upon its previous condition. Finally, if both the set input and the reset input are high simultaneously, the output will go high. The outputs of each of the latch networks are connected to one of a series of corresponding indicating devices which in the preferred embodiment of the present invention are implemented as light emitting diodes (LED's) 120, 122, 124, 126, 128, 130, 132, and 134. The cathodes of the light emitting diodes are connected to ground 136 as illustrated.

A voltage supply 137, which may be a 12 volt supply and which may be the same voltage source as voltage source 102 and/or the 12 volt supply from the alarm system 14, is connected via resistor R2 to normally closed reset switch 138, the other terminal of which is connected to ground 136. The right side of resistor R2 as illustrated in FIG. 1 is also connected to the reset terminal of each of the latch networks 104, 106, 108, 110, 112, 114, 116 and 118 as illustrated.

The operation of the embodiment of the present invention illustrated in FIG. 1 will now be described. In order to set the system, the alarm system 14 is activated and all of the sensor switches 66, 68, 70, . . . , 84 are closed. With all of these sensor switches closed, the current generator from alarm system 14 generates a current that flows through the isolation diode 16, the resistor $R_s$, the terminal contact 18 and thence through each of the sensor switches 66, 68, etc., and through each of the terminal contacts 22, 24, etc. and each of the bridge conductors 52, 54, etc. Further, with all of the sensor switches closed, all of the inputs to the exclusive OR gates 86, 88, . . . , 100 will be at ground potential. Since the inputs to each of the exclusive OR gates are all at the same potential at this time, each of the exclusive OR gates will provide a logic low output.

When one of the zones in the system has been intruded upon, the intrusion will be detected by the corresponding sensor switch within that zone. For instance, assuming an intrusion has occurred within zone 7, sensor switch 82 will open in response to the intrusion. When switch 82 opens, it can be seen that the voltage at each of the terminal contacts 18, 22, . . . , 44 will be pulled up towards the potential of the voltage supply 102. It may also be appreciated that the voltage at terminals 46, 48 and 50 will remain at ground potential. In this example then, the voltage on each of the terminal contacts in the zones 1 through 6 will be a logic high with respect to the input terminals of the exclusive OR gates 86, 88, 90, 92, 94 and 96. The voltage at terminal contact 44 will also be a logic high but the voltage at terminal contact 46 will be a logic low. The voltage at terminal contacts 48 and 50 will likewise both be logic low with respect to exclusive OR gate 100. It should thus be clear that only the exclusive OR gate 98 associated with zone 7 will have inputs that are at different logic levels. The inputs of each of the other exclusive OR gates 86, 88, . . . 96 will all be at logic high levels and the inputs to the exclusive OR gate 100 will both be at logic low levels. In this example, the output from exclusive OR gate 98 will go high while the outputs of each of the other exclusive OR gate within the system will remain low. Since the reset input of latch network 116 is grounded through normally closed reset switch 138, the reset input of latch network 116 will be low. When the set input of latch network 116 goes high upon receipt of the output signal from exclusive OR gate 98, latch network 116 operates to output a logic high on its output terminal thereby energizing light emitting diode 132 and indicating that an intrusion has occurred within zone 7. The LED will remain on until manually reset by the RESET switch 138. Simultaneously, the current generated by alarm system 14 will have been interrupted by the opening of sensor switch 82. Alarm system 14 will thus sound an alarm in response to detection of the interruption of this current as is well known. It can thus be appreciated that an intrusion within any of the zones as detected by any of the reed type sensor switches will simultaneously cause an audible alarm to be heard from alarm system 14 and to energize the corresponding light emitting diode associated with the zone in which the intrusion has occurred.

The reset operation of the embodiment of the present invention illustrated in FIG. 1 will now be described. It can be seen that opening of the normally closed reset switch 138 will cause the reset inputs of the latch networks which are normally grounded to rise to a logic high voltage level. If in the foregoing example the intrusion sensor switch 82 has been reset after tripping open, then the logic high level on the set input of latch network 116 will return to a logic low level. As previously described, when the set input of the latch network is low at the same time that the reset input is high, the output of the latch network will go low. Therefore, if sensor switch 82 has been properly closed to reset the system, opening of normally closed reset switch 138 will result in the turning off of light emitting diode 132. If, however, the system is attempted to be reset by reset switch 138 without sensor switch 82 having been properly closed, the set input of latch network 116 will still be at a logic high level as will the reset input of latch network 116 due to opening of reset switch 138. A simultaneous high on the set and the reset inputs of the latch network 116 will cause a logic high output to appear on the output latch network 116 maintaining light emitting diode 132 in its lighted condition and indicating to the operator that the tripped sensor switch has not properly been reset. It is thus apparent that the system cannot be reset unless the tripped sensor switch has properly been reclosed.

Figure 2:
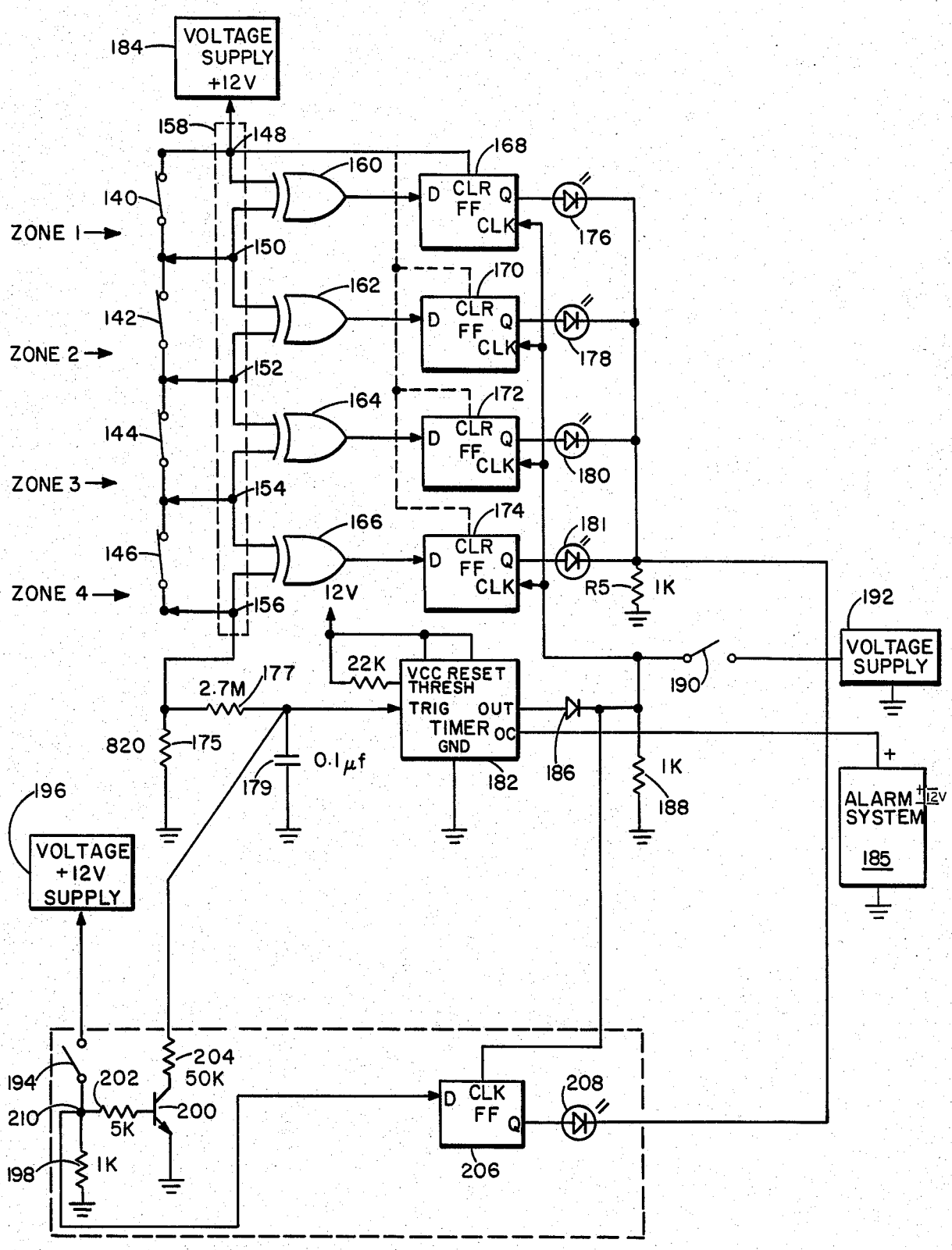
FIG. 2 is a circuit schematic block diagram of a second embodiment of the present invention.

Referring now to FIG. 2 a delayed action zone annunciator embodiment of the present invention will be described. It is well known that alarm systems are highly prone to false alarms. The embodiment of the present invention illustrated in FIG. 2 will not only indicate an attempted point of entry into the protected area but in addition will prevent the generation of false alarms by inadvertent momentary opening of any of the sensor switches and by transients occurring within the system. For purposes of simplification the embodiment of the present invention illustrated in FIG. 2 is shown and described as including four protected zones each of which includes a corresponding intrusion sensor switch 140, 142, 144 and 146. Of course, it should be understood that any number of zones desired may be included within the system. Each of the sensor switches 140, 142, 144 and 146 is preferably implemented as a reed-type sensor switch as previously described and is connected across its corresponding pair of terminal contacts 148, 150, 152, 154 and 156 which may be mounted on terminal strip 158. It is noted that in this embodiment, each of the terminal contacts 150, 152 and 154 is connected to both adjacent switches as opposed to utilization of separate terminal contacts and conductor straps as in the embodiment of FIG. 1. It is to be understood, however, that the technique of using separate terminal contacts for each zone as well as conductor straps as illustrated and described with respect to FIG. 1 may also be utilized in the embodiment in FIG. 2. As in the embodiment of FIG. 1, the embodiment of FIG. 2 includes an exclusive OR gate connected across each terminal pair. Specifically, exclusive OR gate 160 is connected across terminal contacts 148 and 150. Likewise, exclusive OR gate 162 is connected across terminal contacts 150 and 152 and exclusive OR gates 164 and 166 are likewise connected across their corresponding terminal contacts as illustrated. In this embodiment, the output of each of the exclusive OR gates, 160, 162 and 164 and 166 is connected to the D input of its respective D type flip-flop 168, 170, 172 and 174. Each of the D type flip-flops 168, 170, 172 and 174 is an edge triggered flip-flop which operates such that when a logic high appears on its D input and a subsequent logic high appears on its clock input terminal, CLK, then the output, Q, of the D-type flip-flop either goes high or stays high. The Q outputs of the flip-flops 168, 170, 172 and 174 are connected, respectively, to the light emitting diodes 176, 178, 180 and 181, the cathodes of which are all connected via resistor R5 to ground. The clear input to the flip flops is not used and is connected to the positive terminal of the supply voltage. As in the previous embodiment a voltage supply 184 is connected to the terminal contact 148.

Terminal contact 156 has an R-C delay network connected between it and ground. Specifically , the delay network is comprised of resistor 175, resistor 177 and capacitor 179. This delay network is connected to the trigger input of a timer network 182 which preferably is implemented as a model NE555 timer. The timer network 182 operates such that when the voltage at its trigger input drops below a predetermined level, e.g. four volts, the output signal on its output terminal, OUT, will go high. The output on the output terminal, OUT, of timer 182 will remain high until the voltage at the trigger input of the timer 182 rises above the predetermined level. If the trigger input voltage of the timer 182 again rises above that predetermined level then the output of the timer 182 will again go low. Timer network 182 includes an open collector transistor having an output terminal OC that is the collector of that transistor as is well known. In the embodiment of FIG. 2 the current generator of alarm system 185 produces a current which normally flows through the open collector transistor of timer 182. The output of timer 182 is connected via diode 186 through resistor 188 to ground and is also connected via diode 186 to the clock input of each of the flip-flops 168, 170, 172 and 174 as illustrated. A normally open, momentary-close type reset switch 190 is connected at one end to a voltage supply 192 which may be the 12 volt supply provided in alarm system 185 as is well known or which may be an external voltage supply. The other end of normally-open, momentary-close reset switch 190 is connected to the clock inputs of the D-type flip-flops 168, 170, 172 and 174.

The operation of the embodiment of the present invention illustrated in FIG. 2 will now be described. Assuming that the alarm system 185 has been armed and that each of the sensor switches 140, 142, 144 and 146 is properly closed, and assuming that power has been provided to timer network 182, as from a 12 volt supply illustrated by way of example, then current will flow from the alarm system through the open collector transistor of the timer 182. Each of the inputs to each of the exclusive OR gates 160, 162, 164 and 166 will be at a voltage level approximately the same as voltage supply 184 assuming all of the sensor switches are properly closed. A voltage will appear across the resistor 175 causing capacitor 179 to become fully charged to the supply voltage such that the trigger input of the timer 182 is considerably above the trigger threshold. Also, at this time, since the inputs of all of the exclusive OR gates are at the same logic levels, the outputs of all of the exclusive OR gates are at logic low levels. The D inputs of each of the flip-flops 168, 170, 172 and 174 will all be low therefore resulting in low outputs on the Q outputs of each of the flip-flops. In this condition the light emitting diodes will all be de-energized.

If an intrusion is detected by any of the sensor switches, the sensor switch in the zone intruded upon will open, causing disconnection of the voltage supply 184 from the resistor 175 and resulting in a drop in the previously existing voltage across resistor 175. As the voltage drops across resistor 175, capacitor 179 will discharge through resistors 177 and 175 toward ground. After a predetermined amount of time, depending upon the particular values of the resistors 175, 177 and capacitor 179, capacitor 179 will discharge to the predetermined level at which the trigger threshold of the timer 182, will be reached. When this trigger level is reached the voltage on the output terminal of timer 182 will go high causing a positive clock pulse to appear at the clock inputs of each of the flip-flops 166, 170, 172 and 174. Assuming, for instance, the intrusion has occurred in zone 1, then flip-flop 168 will immediately have a logic high input at its D input. If switch 140 remains open until the trigger threshold of timer 182 is reached, then 182 will generate a positive output, thereby applying a clock pulse to all the flip-flops. This action will cause a logic high output to appear on the Q output of flip-flop 168 thereby activating light emitting diode 176. If, however, the opening of sensor switch 140 in zone 1 was caused by a momentary shock such that sensor switch 140 only briefly opens and then closes again, capacitor 179 will not have had sufficient time to discharge to the trigger level of timer 182. In such an instance no intrusion display will be indicated and no false alarm will be generated. It is also noted that should the opening of any of the sensor switches be of sufficiently long duration to cause capacitor 179 to discharge to a sufficiently low level such that the trigger threshold of timer 182 is reached, in that event the open collector transistor of timer 182 will cease conducting thereby interrupting the current generated by alarm system 185 which, as is well known, will detect such interruption of current and sound an audible alarm. It is also noted at this point that, were a voltage transient to occur anywhere in the alarm system 185 or within the series circuit of the sensor switches 140, 142, 144 and 146, this transient would have no effect upon the display system or the alarm system 185 and neither would an audible alarm be heard nor would any of the light emitting diodes 176, 178, 180 or 181 be activated. A D-type flip-flop operates such that its output is pulled to the same level as its input upon receipt of a logic high clock pulse. In other words if the D input of the flip-flop is at a logic low level when a logic high clock pulse is received then the output will go to a logic low level. If the D input of the flip-flop is at a logic high level when the logic high clock pulse is received, then the output of the flip-flop will go to a logic high level. Therefore, in order to reset the system of FIG. 2, the tripped sensor switch must first be closed. Closure of the tripped sensor switch will cause a logic low to appear at the D input of the flip-flop corresponding to that zone. Upon closure of the normally open reset switch 190, a logic high clock pulse will appear at the clock input of the flip-flop thereby causing its Q output to go to a logic low level, resulting in de-energization of the corresponding light emitting diode. If, however, the sensor switch has not properly been reset, momentary closure of the reset switch 190 will not result in deactivation of the corresponding light emitting diode because the flip-flop corresponding to the zone in which the intrusion occurred will still have a logic high appearing at its D input at that time.

As an optional feature of the present invention, an indication of an intrusion into a monitored zone may be triggered by the closing of a normally open switch. In that regard, referring to FIG. 2 there is illustrated a normally open switch 194. Switch 194 is connected between a positive voltage supply 196 or, alternately, to the 12 volt supply of alarm system 184, and thence through resistor 198 to ground. Normally open switch 194 may be placed under a mat in a doorway, under carpeting or in a similar area where an intruder would be likely to step on it without being made aware that he had done so. An NPN transistor 200 has its base connected through resistor 202 to the juncture of switch 194 and resistor 198. The collector of transistor 200 is connected through resistor 204 to the juncture of capacitor 179 and resistor 177. As is illustrated, the emitter of transistor 200 is connected to ground. The D input of the D-type flip-flop 206 is also connected to the juncture of switch 194 and resistor 198. The Q output of D-type flip-flop 206 is connected to light emitting diode 208, the cathode of which is connected to resistor R5 as is illustrated. The clock input, CLK, of flip-flop 206 is connected to the output of timer 182 via diode 186.

The normally opened switch optional feature of the present invention operates as follows. With normally open switch 194 in the open position, it can readily be seen that transistor 200 is in the non-conducting condition due to the fact that its base is not positive with respect to its emitter. Transistor 200 is thus cut off and the D input of flip-flop 206 is held at ground potential since there is no voltage at the top of resistor 198. The Q output of flip-flop 206 is therefore low and light-emitting diode 208 is off. If the normally open switch 194 is closed as by an intruder stepping upon it, voltage supply 196 is connected to juncture 210, bringing the base of transistor 200 positive with respect to its emitter. This action causes transistor 200 to conduct in the saturation region effectively connecting the collector of transistor 200 to ground. Upon conduction of transistor 200, capacitor 179 discharges through resistor 204 and transistor 200 to ground. When capacitor 179 has discharged to the triggering threshold of timer 182 as previously described, assuming switch 194 remains closed long enough, timer 182 will generate a clock pulse on its output terminal, OUT, via diode 186 to the clock input, CLK, of flip-flop 206. Assuming that the switch 194 is closed at this time, there will be a high input at the D input of flip-flop 206. This simultaneous high on the D input of flip-flop 206 and a positive clock pulse therefore will result in a high signal appearing at the Q output of flip-flop 206, thereby activating light emitting diode 208. Lighting of the light emitting diode 208 of course will indicate that an intrusion has occurred in the zone being monitored by normally open switch 194.

It is noted that specific values of the components of the present invention have been illustrated in the drawings and that specific commercially available part numbers have been identified. It is to be understood that these values and part numbers are by way of example only and that it is within the scope of the present invention to utilize different values for the components depending upon the system requirements and that other models of components than those specifically identified may be utilized. In the above example, the time constants determined by components 175, 177, and 179 were selected such that the system is immune to triggering by an involuntary momentary opening of a sensor switch of induced electrical transients in the sensor loop, yet will be triggered by opening of a switch long enough to enable an intruder to pass, for example, about one second.

The time constant determined by components 197 and 202 for the optional normally-open circuit was selected to trigger the alarm if a normal step lasting $\frac{1}{4}$ second or longer is detected, but will not trigger if the switch is closed by a momentary shock or vibration which often occurs in some environments.

Obviously, many modifications and variations of the present invention are possible in the light of the above teachings. It is therefore to be understood that within the scope of the appended claims the invention may be practiced otherwise than as specifically described.

What is claimed is:

1. An alarm system comprising:
a plurality of sensing means for detecting intrusion into a plurality of areas;
a plurality of zone indicating means, each being connected to a distinct one of said sensing means for indicating which one of said sensing means has detected an intrusion, each of said zone indicating means being substantially identical;
each of said zone indicating means comprising an exclusive OR gate connected across one of said plurality of said sensing means.

2. The alarm system of claim 1 wherein:
each of said plurality of sensing means comprises a switch.

3. The alarm system of claim 2 wherein:
each of said switches is a normally closed reed sensor switch.

4. The alarm system of claim 3 wherein:
said plurality of reed sensor switches are connected in series.

5. The alarm system of claims 1, 2, 3 or 4 wherein each of said zone indicating means further comprises:
a latch network operably coupled to the output of said exclusive OR gate.

6. The alarm system of claim 5 wherein:
each said latch network comprises a set/reset latch network.

7. The alarm system of claim 6 wherein:
each said latch network comprises a set dominant latch network.

8. The alarm system of claim 7 further comprising:
a plurality of indicator lights each being connected to one of said latch networks.

9. The alarm system of 8 wherein:
each of said indicator lights comprises an LED.

10. The alarm of system of claim 6 wherein:
each said latch network includes a set terminal and a reset terminal;
the set terminal of each said latch network being connected to one of said exclusive OR gates.

11. The alarm system of claim 10 further comprising:
a reset switch connected to the reset terminals of all of said latch networks.

12. The alarm system of claim 11 further comprising:
a power supply connected to said reset switch and to said reset terminals.

13. The alarm system of claim 12 further comprising:
means connected to said plurality of sensing means for generating an audible signal in response to an intrusion detection by any of said sensing means.

14. The alarm system of claim 13 wherein:
said means for generating an audible signal is further for generating a current through said plurality of sensing means and for generating said audible signal in response to detecting interruption of said current.

15. The alarm system of claim 5 further comprising:
a plurality of indicator lights each being connected to one of said latch networks.

16. The alarm system of claims 1, 2, 3 or 4 wherein each of said zone indicating means further comprises:
a flip-flop network operably coupled to the output of said exclusive OR gate.

17. The alarm system of claim 16 wherein:

each said flip-flop network comprises an edge-triggered flip-flop.

18. The alarm system of claim 17 wherein:

each said flip-flop network comprises a D type flip-flop.

19. The alarm system of claim 17 wherein:

each of said flip-flop network includes a clock input terminal; and said alarm system further comprises a timer network having an output connected to said clock input terminal of each of said flip-flop networks.

20. The alarm system of claim 19 further comprising:

means operably coupled to said plurality of sensing means for providing a trigger signal to said timer network after a predetermined time delay in response to an intrusion detection by any of said sensing means.

21. The alarm system of claim 20 wherein:

said trigger signal providing means comprises a delay network.

22. The alarm system of claim 21 wherein:

said delay network comprises an R-C delay network.

23. The alarm system of claim 21 wherein:

said timer includes a normally conducting transistor means for becoming non-conducting in response to said trigger signal.

24. The alarm system of claim 23 further comprising:

means connected to said timer for generating an audible signal in response to an intrusion detection by any of said sensing means.

25. The alarm system of claim 23 wherein said means for generating an audible signal is further for generating a current through said transistor and for generating said audible signal in response to detecting interruption of said current.

26. The alarm system of claim 19 further comprising:

normally open switch means operably coupled to said timer for closing in response to intrusion into an area.

27. The alarm system of claim 26 further comprising:

means operably coupled to said plurality of sensing means for providing a trigger signal to said timer network after a predetermined time delay in response to an intrusion detection by any of said sensing means or by said normally open switch means.

28. The alarm system of claim 27 further comprising:

a normally non-conducting transistor coupled to said normally open switch means and being responsive to closure of said normally open switch means to become conducting.

29. The alarm system of claim 28 further comprising:

a flip-flop network operably coupled to said normally non-conducting transistor; and an LED operably coupled to said flip-flop.

30. The device of claim 1 wherein:

each of said sensing means comprises conductive metallic tape.

31. In an alarm system including a plurality of series connected sensor switches each having a set and a tripped position and further including a current generator for generating an electrical current and including means for detecting the interruption of said electrical current and for sounding an alarm in response to said detection of interruption of electrical current, the improvement comprising:

a plurality of zone indicating means, each having an indicating state and a normal non-indicating state, each being connected to a distinct one of said sensing means for changing from said normal non-indicating state to said indicating state for indicating which one of said sensing means has changed from said set to said tripped position;

means operably coupled to said plurality of zone indicating means for preventing resetting of each of said plurality of zone indicating means from said indicating state to said non-indicating state while its corresponding distinct one of said plurality of sensing means is in said tripped position.

32. The alarm system of claim 31 wherein:

each of said plurality of series connected sensor switches is normally closed in said set position.

33. In an electrical alarm system which is susceptible to the occurrence of electrical transients therein and including a plurality of series connected sensor switches each having a set and a tripped position and further including a current generator for generating an electrical current and including means for detecting the interruption of said electrical current and for sounding an alarm in reponse to said detection of interruption of electrical current, the improvement comprising:

a plurality of zone indicating means, each having an indicating state and a normal non-indicating state, each being connected to a distinct one of said sensing means for changing from said normal non-indicating state to said indicating state for indicating which one of said sensing means has changed from said set to said tripped position, and each of said plurality of zone indicating means being further for inhibiting a change from said non-indicating to said indicating state on the occurrence of said electrical transient.

34. An alarm system comprising:

a plurality of sensing means for detecting intrusion into a plurality of areas, each of said plurality of sensing means comprising a normally closed reed sensor switch, said plurality of reed sensor switches being connected in series; and a plurality of zone indicating means, each being connected to a distinct one of said sensing means for indicating which one of said sensing means has detected an intrusion, each of said zone indicating means being substantially identical.

* * * * *